United States Patent [19]

Kao et al.

[11] Patent Number: 4,890,775

[45] Date of Patent: Jan. 2, 1990

[54] APPARATUS FOR MAKING DEEP FLUTE SHADE

[76] Inventors: Jamee Kao, 2400 S. Whitehall Dr. - #2060, Mundelein, Ill. 60060; Joseph C. S. Hsu, 35 Lane 461 Chung-Shan N. Road Sec. 5, Taipei, Taiwan, 111

[21] Appl. No.: 286,369

[22] Filed: Dec. 19, 1988

Related U.S. Application Data

[63] Continuation of Ser. No. 34,057, Apr. 3, 1987.

[51] Int. Cl.[4] ..... D06J 1/04

[52] U.S. Cl. ..... 223/32; 28/279; 425/336

[58] Field of Search ..... 425/336; 156/474; 223/28, 32; 26/69 R, 1; 28/279

[56] References Cited

U.S. PATENT DOCUMENTS

| | | | |
|---|---|---|---|
| 217,670 | 7/1879 | Adreance | 28/279 X |
| 246,011 | 8/1881 | Hose | 223/32 |
| 1,399,231 | 12/1921 | Whyte | 223/32 |
| 1,904,030 | 4/1933 | Post | 223/32 |
| 2,623,266 | 12/1952 | Hemmi | 28/279 X |
| 2,636,250 | 4/1953 | Hemmi | 28/279 |

FOREIGN PATENT DOCUMENTS

| | | | |
|---|---|---|---|
| 2113625 | 9/1972 | Fed. Rep. of Germany | 223/32 |
| 10186 | of 1844 | United Kingdom | 223/32 |
| 1515 | of 1858 | United Kingdom | 223/32 |
| 506 | of 1864 | United Kingdom | 223/32 |

*Primary Examiner*—Werner H. Schroeder
*Assistant Examiner*—David K. Suto

[57] ABSTRACT

A pleating machine with two engaging pleat forming chain conveyors, one with forming rollers and the other with forming plates both directly mounted on special links in the chains.

5 Claims, 3 Drawing Sheets

APPARATUS FOR MAKING DEEP FLUTE SHADE

RELATED APPLICATION

This application is a continuation of our U.S. patent application Ser. No. 034,057 filed Apr. 3, 1987, now abondoned.

BACKGROUND OF THE INVENTION

Pleating machines commonly include a pair of adjacent endless forming conveyors each carrying a plurality of cooperating but staggered forming tools that engage and form pleats in an endless web of material that is pleated as the material moves between the forming conveyors.

It is also common for these pleating machine conveyors to each include one or two spaced endless chains upon which the pleat forming tools are mounted. In the past, complicated brackets have been provided for mounting the forming tools on these chains.

It is a primary object of the present invention to ameliorate the problems noted above by simplifying the mounting of forming tools on the conveyor chains and to provide forming tools which form serial deep flutes in an endless web of sheet material.

SUMMARY OF THE PRESENT INVENTION

In accordance with the present invention a pleating machine is provided for forming serial deep flutes in a sheet of material in a simple fashion with cooperating forming rollers on one conveyor and forming plates on the other conveyor both directly mounted on unique links in the conveyor. In this way complicated mounting brackets for forming tools in prior pleating machines are completely eliminated.

Toward these ends, the links on the forming roller conveyor have integral coplanar outwardly extending flanges that directly receive forming roller shafts. The forming plate conveyor includes integral flanges extending transversely from the bases of the forming plates and the chain links have integral flanges extending transversely outwardly to which these base flanges on the forming plates are directly mounted without any additional bracketry.

In this way the forming rollers and forming plates are mounted in a much simplified manner resulting in a pleating machine which is less costly yet extremely efficient for forming deep flutes in sheet material.

Other objects and advantages of the present invention will appear from the following detailed description of the invention.

DETAILED DESCRIPTION OF THE PREFERRED EMBODIMENT

Figure 1:
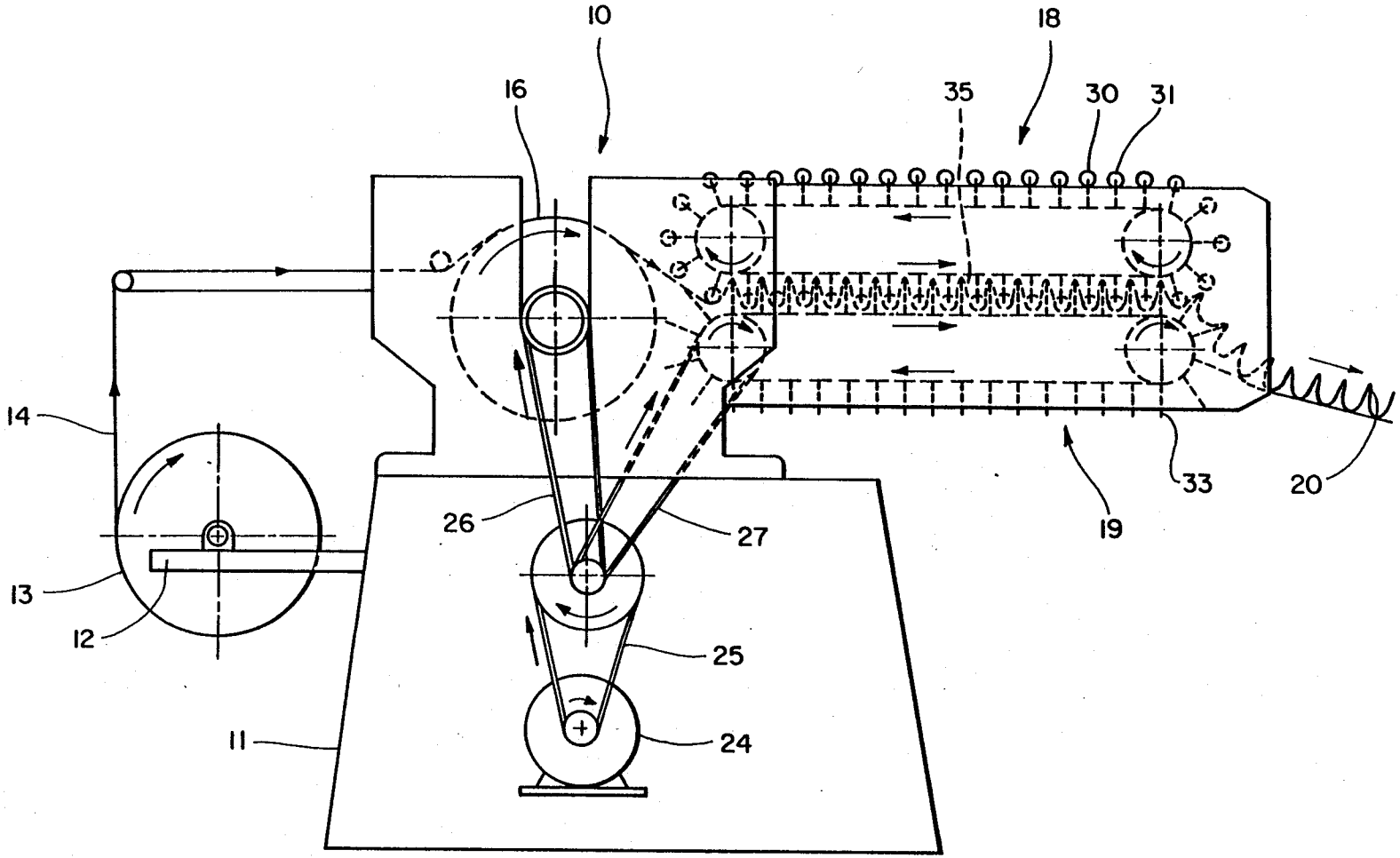
FIG. 1 is a diagramatic side view of the pleating machine according to the present invention.

Referring to the drawings and particularly FIG. 1, a pleating machine 10 is illustrated according to the present invention generally including a base 11 having a support 12 for a roll 13 of web-fed material 14 which passes over a heating roller 16 to a pair of overlapping endless forming conveyors 18 and 19 from which serially deep fluted pleated material 20 exits.

The heating roller 16 and the endless conveyors 18 and 19 are driven by motor 24 through chains 25, 26 and 27.

To form the deep fluted pleats as shown at 20, endless forming conveyor 18 carries a plurality of forming rollers 30 having annular forming ends 31 that cooperate with a plurality of point ended forming plates 33 on conveyor 19, which as shown are staggered with the forming rollers 30 as they mesh at 35 in co-linear travel with web 14 therebetween.

Figure 2:
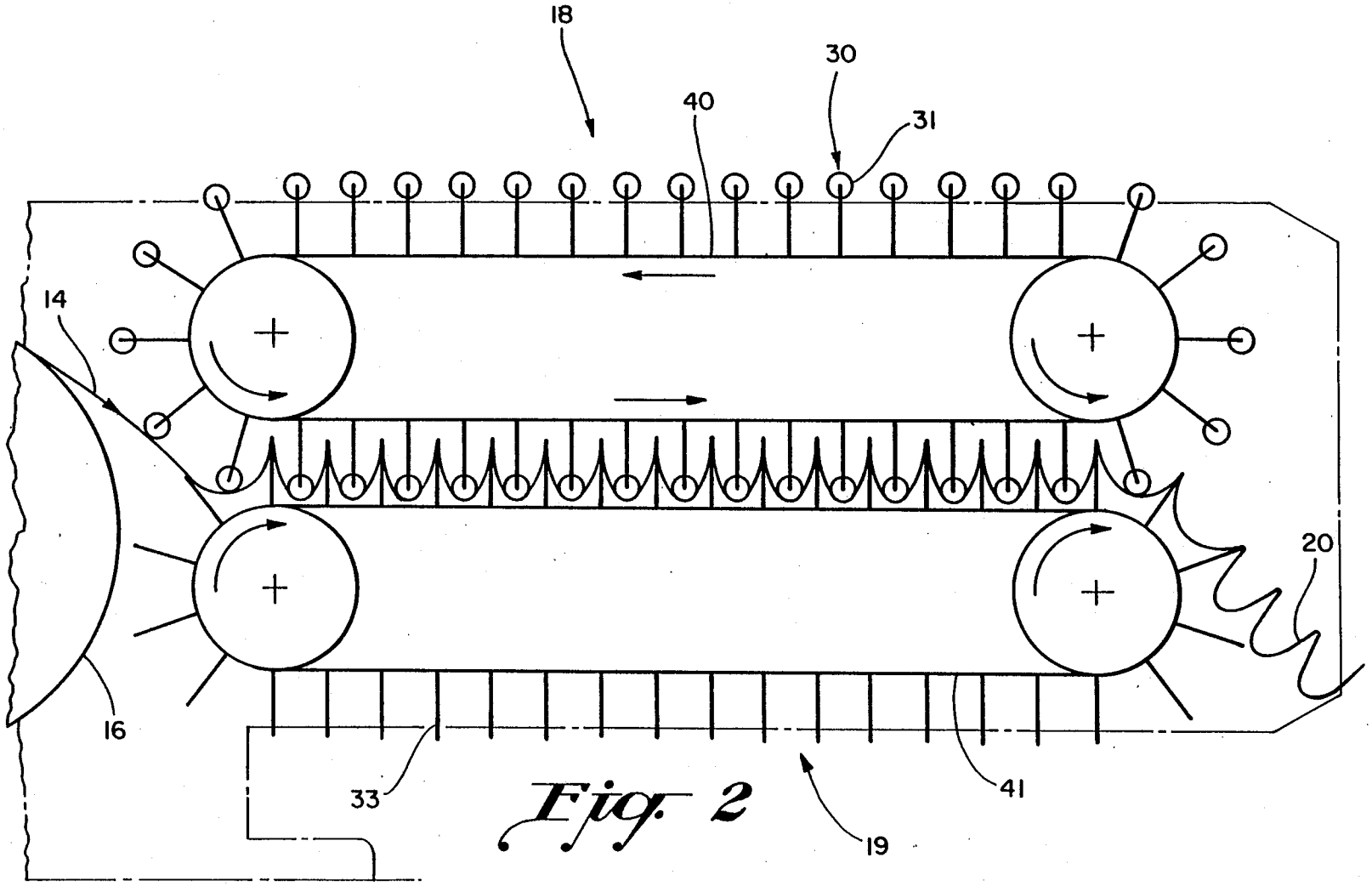
FIG. 2 is a sub-assembly of the two cooperating forming conveyors in the pleating machine illustrated in FIG. 1.

As seen more clearly in FIG. 2, forming conveyor 18 includes a pair of spaced parallel endless chains 40, and conveyor 19 includes a similar pair of spaced parallel endless chains 41 (shown diagramatically in FIG. 2), each including a plurality of links.

Figure 3:
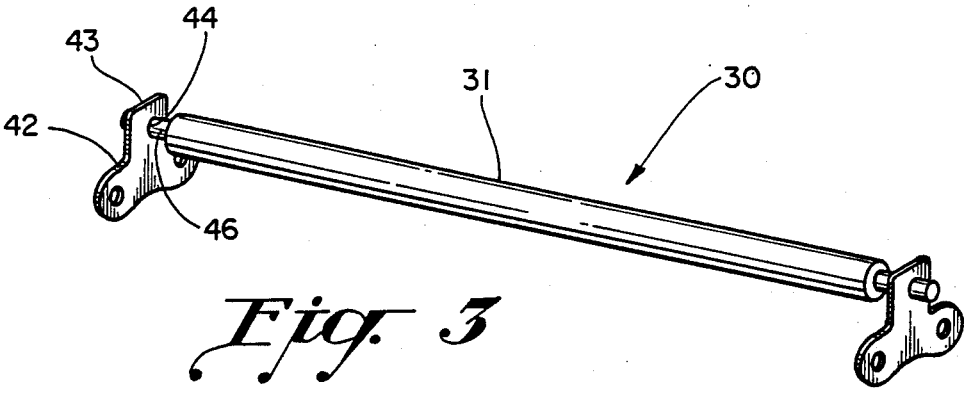
FIG. 3 is a perspective sub-assembly view of one of the forming rollers supported on one of the links in the chains associated with the forming roller conveyor.

Each link in the chains 40 has one side plate 42 with an integral coplanar upwardly extending flange 43 with an aperture 44 extending therethrough as seen in FIG. 3. Aperture 44 is sized to receive reduced shaft portion 46 on forming roller 30.

Figure 4:
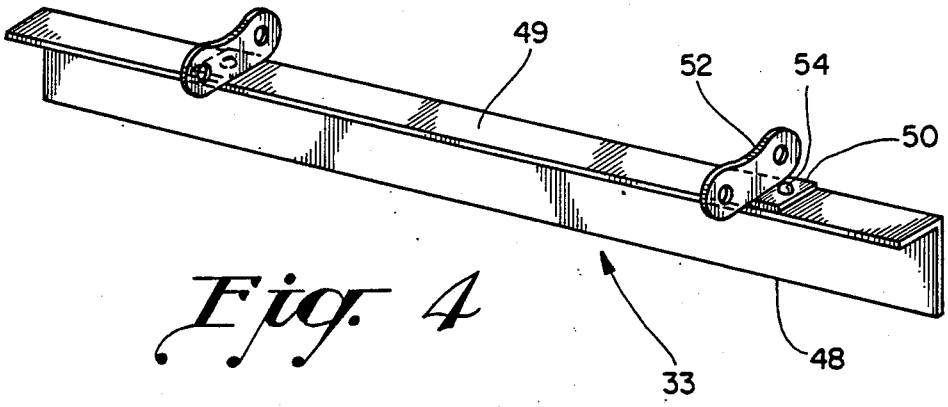
FIG. 4 is a perspective view of one of the forming plates in the forming plate conveyor shown mounted on a pair of links in the chains associated with the forming plate conveyor.

As seen in FIG. 4, the forming plates 33 have a working knife edge 48 and a transversely extending base flange 49 which is mounted directly on link flanges 50.

Each of the links in conveyor chains 41 has one side plate 52 that has an integral outwardly extending transverse flange 50 to which the forming plate faces 49 are fixed by a fastener 54.

This arrangement eliminates the need for any complex mounting brackets between the forming tools and the traveling chains.

We claim:

1. A pleating machine, comprising: means for web-feeding a sheet of material, two opposed, adjacent endless forming conveyors for receiving and pleating the sheet material, each of said forming conveyors including at least one endless chain, said chains including a plurality of pivotally inter-connected links, one of said conveyors having a plurality of forming rollers mounted on the links associated therewith, the other of said conveyors having a plurality of forming plates supported on the links associated with that conveyor, at least some of said other conveyor chain links including integral flanges extending in a direction generally perpendicular to the links, said forming plates having integral base flanges extending generally perpendicular to the plates, and means for fastening the base flanges directly to the link flanges, whereby the forming plates are simply supported by the chain on the said other conveyor.

2. A pleating machine as defined in claim 1, wherein at least some of the links on the chain of said one conveyor have an integral coplanar flange, and means for supporting the forming rollers on the coplanar flanges.

3. A pleating machine as defined in claim 1, wherein the forming plates are thin and arranged to alternate with the forming rollers whereby the pleating machine forms serial deep flutes in the sheet material.

4. A pleating machine as defined in claim 1, wherein a heating arrangement is provided for the sheet material in advance of the forming conveyors.

5. A pleating machine, comprising: means for web-feeding a sheet of material, two opposed, adjacent endless forming conveyors for receiving and pleating the sheet material, each of said forming conveyors including at least one endless chain, said chains including a plurality of pivotally inter-connected links, one of said conveyors having a plurality of forming rollers mounted on the links associated therewith, the other of said conveyors having a plurality of forming plates supported on the links associated with that conveyor, at least some of said other conveyor chain links including integral flanges extending in a direction generally perpendicular to the links, said forming plates having integral base flanges extending generally perpendicular to the plates, means for fastening the base flanges directly to the link flanges, whereby the forming plates are simply supported by the chain on the said other conveyor, at least some of the links on the chain of said one conveyor having an integral coplanar flange, and means for supporting the forming rollers on the coplanar flanges, said forming plates being thin and arranged to alternate with the forming rollers whereby the pleating machine forms serial deep flutes in the sheet material.

* * * * *